US006884557B2

(12) United States Patent
Kasai et al.

(10) Patent No.: US 6,884,557 B2
(45) Date of Patent: Apr. 26, 2005

(54) DESENSITIZING TREATMENT LIQUID FOR LITHOGRAPHIC PRINTING

(75) Inventors: Seishi Kasai, Shizuoka (JP); Tadahiro Sorori, Shizuoka (JP); Ryosuke Itakura, Shizuoka (JP); Eiichi Kato, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/348,410

(22) Filed: Jan. 21, 2003

(65) Prior Publication Data

US 2003/0194623 A1 Oct. 16, 2003

Related U.S. Application Data

(63) Continuation of application No. 09/153,117, filed on Sep. 15, 1998, now abandoned, which is a continuation of application No. 08/766,418, filed on Dec. 12, 1996, now abandoned.

(30) Foreign Application Priority Data

Dec. 14, 1995 (JP) ..... 7-325815

(51) Int. Cl.[7] ..... G03G 9/00
(52) U.S. Cl. ..... 430/104; 430/49; 106/2
(58) Field of Search ..... 430/97, 104, 331, 430/49; 106/2; 101/451, 466, 465

(56) References Cited

U.S. PATENT DOCUMENTS 4,579,591 A * 4/1986 Suzuki et al. ..... 106/2
5,001,041 A * 3/1991 Kishimoto et al. ..... 430/372
5,302,311 A * 4/1994 Sugihara et al. ..... 252/102
5,525,458 A * 6/1996 Takizawa ..... 430/331

FOREIGN PATENT DOCUMENTS

FR 2127633 * 10/1972
JP 61-230 990 * 10/1986
JP 1-319034 * 12/1989

OTHER PUBLICATIONS

US Patent & Trademark Office English—Language Translation of JP 1–319034 (pub Dec. 89).*

US Patent & Trademark Office English–Language Translation (PTO–97–4230) of JP 61–230990 (pub Oct. 1986).*

US Patent & Trademark Office English–Language Translation (PTO97–4268) of French Patent 2,127,633 (pub. Oct. 1972) .*

* cited by examiner

*Primary Examiner*—Janis L. Dote
(74) *Attorney, Agent, or Firm*—Sughrue Mion, PLLC

(57) ABSTRACT

A desensitizing treatment liquid for offset printing plates, which contains a compound represented by formula (I)

(I)

wherein ϕ represents —$PO_3H_2$, —$OPO_3H_2$, or the salt thereof and $R_1$ represents an organic residue which may have a substituent. The desensitizing treatment liquid gives no problems to environmental pollution, is stable to the long-period storage and the continuous use, can shorten the etching treatment time, and is excellent in the desensitizing treatment ability as well as can provide an offset printing plate having a good reproducibility of highly minute images of a middle tone, screen tint, etc., and capable of printing without forming scumming at the non-image area.

20 Claims, No Drawings

DESENSITIZING TREATMENT LIQUID FOR LITHOGRAPHIC PRINTING

This is a continuation of application Ser. No. 09/153,117 filed Sep. 15, 1998, now abandoned, which is a continuation of Ser. No. 08/766,418 filed Dec. 12, 1996, now abandoned.

FIELD OF THE INVENTION

The present invention relates to a desensitizing treatment liquid for lithographic printing, and more specifically to a desensitizing treatment liquid being used for a lithographic printing plate mainly composed of a metal oxide, a metal sulfide, and a binder resin, such as an electrophotographic printing master plate, a direct printing type printing master plate, etc.

BACKGROUND OF THE INVENTION

An electrophotographic lithographic printing master plate has a photosensitive layer composed of a binder resin having dispersed therein a photoconductive fine powder such as a metal oxide (e.g., zinc oxide, titanium oxide, etc.) and a metal sulfide (e.g., zinc sulfide, etc.) and printing images are obtained by applying an ordinary electrophotographic processing onto the layer to form ink-receptive images thereon.

In general, for offset printing, a printing plate composed of a non-image area (hydrophilic area) which is liable to be wetted with water and an image area (ink-receptive area) which is reluctant to be wetted with water is used but since an electrophotographic offset printing master plate is composed of a hydrophobic photoconductive layer, if printing is applied using the printing master plate as it is, a printing ink also attaches to the non-image area and thus normal printing cannot be performed.

Accordingly, it is necessary to subjecting the non-image area to a desensitizing treatment prior to printing to render the non-image area hydrophilic. Hitherto, as the desensitizing treatment liquid, a cyan compound-containing treatment liquid containing a ferrocyanate or a ferricyanate as the main component and a cyan-free treatment liquid containing an ammine cobalt complex, phytic acid (inositol hexaphosphate) and the derivative thereof, or a guanidine derivative as the main component are proposed.

However, these treatment liquids are not said to be the treatment liquids which can be sufficiently satisfactory. That is, in the case of the former desensitizing treatment liquid containing a ferrocyanate or a ferricyanate, there are advantages that the treatment liquid has a strong desensitizing power, has a faculty of forming a strong hydrophilic coated film, and the film-forming speed is high but the former desensitizing treatment liquid has the disadvantages that the ferrocyanate ion or the ferricyanate ion is unstable to light, when the ion is exposed to light, the ion is colored and precipitates form to weaken the desensitizing power, and further since the treatment liquid contains the cyan ion (CN), when free cyan is detected, it causes various problems in the points of environmental pollution such as the waste solution, etc.

On the other hand, by considering the points described above, the latter cyan-free treatment liquid containing an ammine cobalt complex, phytic acid, a guanidine derivative, etc., as the main component is proposed but the cyan-free treatment liquid cannot yet be said to be a treatment liquid of obtaining a sufficiently satisfactory lithographic printing master plate. Practically, the latter treatment liquid has the disadvantages that the film-forming speed by the treatment liquid is slow as compared with the former treatment liquid and in an etching system of using a processor, by passing once a lithographic printing master plate, through the processor, a hydrophilic coated film having a high physical strength capable of immediately printing cannot be formed, and scumming occurs and the halftone dot gradation is plugged.

Hitherto, it is well known that phytic acid and the metal derivative thereof form metal chelate compounds, and phytic acid and various derivatives thereof are proposed as the desensitizing agent for offset printing master plates. However, the desensitizing treatment liquid containing each of these desensitizing agents has as slow film-forming speed and by the one treatment of the processor, a hydrophilic coated film capable of printing is not formed, which cause the disadvantages that the ink separation property is bad and scumming and plugging of the halftone dot gradation occur.

Thus, the investigations of adding various additives to the phytic acid series treatment liquids have been made for solving the problems described above.

Practically, there are the phytic acid series treatment liquid using the metal complex of an amino-carboxylic acid together as described in JP-B-2-39397 (the term "JP-B" as used herein means an "examined Japanese patent publication"), the phytic acid series treatment liquid using a hexametaphosphate together as described in JP-B-62-7597, the phytic acid treatment liquid added with a lower amine, an alkanolamine, a polyamine, etc., as described in JP-A-54-117201, JP-A-53-109701, JP-A-1-25994, etc., (the term "JP-A" as used herein means an "unexamined published Japanese patent application"), etc. These treatment liquids have a good water receptivity at the beginning of use but have the problems that when they are continuously used, etching is lowered and the water receptivity is lowered, and when these treatment liquids are used after storing for a long period of time, the water receptivity is lowered and scumming occurs, whereby the sufficient effects are not obtained in the case of using these treatment liquids.

Moreover, there is the treatment liquid added with a cationic polymer described in JP-A-60-23099 but when the treatment liquid is continuously used or after storing the treatment liquid for a long period of time, the faculty thereof is lowered and a rust forms as in the case of using the treatment liquids described above.

Furthermore, the phytic acid series desensitizing treatment liquid using a polyethyleneimine copolymer together is proposed as described in JP-A-7-68967, JP-A-7-137475, etc.) is proposed but in the treatment liquid, the problems that the latitude of both the formation of the hydrophilic property at the non-image area by etching and the formation of the ink-attaching property to the image area is narrow, when the treatment liquid is continuously used for a long period of time, the faculty is lowered, etc., have not yet been solved.

On the other hand, recently, from the view point of work-saving, the spread of particularly small-sized automatic printing machines each incorporated with a desensitizing treatment system is remarkable, also in the offset master by an electrophotographic system, shortening of time to printing plate making is carried out, and there are circumstances which have to meet quickening of the desensitizing treatment time and prolonging the life of the treatment liquid.

Furthermore, in the system of an electrophotographic lithographic master plate, a digital exposing system is proposed, in addition to the conventional process images mainly composed of line images and letters, the preparation of a maser plate having highly minute images of a middle tone, screen tint, etc., becomes easy, and in a printing process, a printing plate capable of reproducing the highly minute images on a printed matter has been demanded. However, it is difficult to meet the demand by using conventionally known desensitizing treatment liquids.

SUMMARY OF THE INVENTION

An object of the present invention is to provide a desensitizing treatment liquid for offset printing plates excellent in the desensitizing treatment ability, which does not cause the problem of environmental pollution, is stable to the storage of a long period of time and to the continuous use, and further can shorten the etching treatment time.

Also, another object of this invention is to provide a desensitizing treatment liquid for offset printing plates capable of making an offset printing plate which has a good reproducibility of highly minute images of a middle tone, screen tint, etc., and can carry out printing without forming scumming on the non-image area.

That is, it has now been discovered that the objects described above can be achieved by using the following cyan-free desensitizing treatment liquid of the present invention for etching.

The cyan-free desensitizing treatment liquids of this invention are as follows.

The 1st aspect of this invention is a desensitizing treatment liquid for lithographic printing, which contains at least one kind of a compound represented by formula (I)

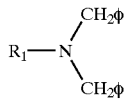

(I)

wherein ϕ represents —$PO_3H_2$, —$OPO_3H_2$, or the salt thereof and $R_1$ represents a hydrogen atom or an organic residue which may have a substituent, said compound being capable of chelating with polyvalent metal ion which is generated from a metal oxide or a metal sulfide existing on the surface of a lithographic printing plate by etching treatment to form a sparingly water-soluble precipitation.

The 2nd aspect of this invention is a desensitizing treatment liquid for lithographic printing, which contains at least one kind of a compound represented by formula (II)

$$R_1—(NZ_n)_m \quad \text{(II)}$$

wherein Z represents —$CH_2$ϕ or a hydrogen atom; n is 2 and m represents an interger so that there are at least five —$CH_2$ϕ; ϕ represents —$PO_3H_2$, —$OPO_3H_2$, or the salt thereof and $R_1$ represents a hydrogen atom or an organic residue which may have a substituent, said compound being capable of chelating with a polyvalent metal ion which is generated from a metal oxide or a metal sulfide existing on the surface of a lithographic printing plate by etching treatment to form a sparingly water-soluble precipitation.

The 3rd aspect of this invention is a desensitizing treatment liquid for lithographic printing, which contains at least one kind of a compound represented by formula (III)

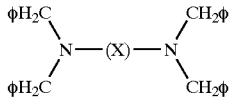

(III)

wherein X represents an alkylene linkage group having from 3 to 10 carbon atoms or a cycloalkyl linkage group having from 3 to 10 carbon atoms, each group may be substituted; and ϕ represents —$PO_3H_2$, —$OPO_3H_2$, or the salt thereof, said compound being capable of chelating with a polyvalent metal ion which is generated from a metal oxide or a metal sulfide existing on the surface of a lithographic printing plate by etching treatment to form a sparingly water-soluble precipitation.

The 4th aspect of this invention is a desensitizing treatment liquid for lithographic printing, which contains at least one kind of a compound represented by formula (IV)

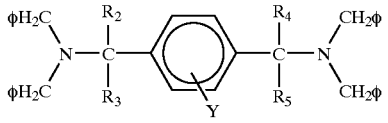

(IV)

wherein $R_2$ to $R_5$ each represents a hydrogen atom, an alkyl group having from 1 to 3 carbon atoms, which may be substituted, or a halogen atom; Y represents a hydrogen atom, an alkyl group having from 1 to 6 carbon atoms, which may be substituted, an alkoxy group which may be substituted, a halogen atom, an amino group, a nitro group, a cyano group, a carboxy group, or a hydroxy group; and ϕ represents —$PO_3H_2$, —$OPO_3H_2$, or the salt thereof, said compound being capable of chelating with a polyvalent metal ion which is generated from a metal oxide or a metal sulfide existing on the surface of a lithographic printing plate by etching treatment to form a sparingly water-soluble precipitation.

The 5th aspect of this invention is the desensitizing treatment liquid for lithographic printing of the foregoing 3rd aspect, wherein X of the formula (III) is an alkylene linkage chain having from 3 to 5 carbon atoms.

Further, in the 2nd aspect of this invention, the compound represented by formula (II) is preferably a compound represented by formula (II-1);

$$R_1—[N(CH_2\phi)_2]_{m'} \quad \text{(II-1)}$$

wherein m' represents an integer of from 3 to 10; ϕ represents —$PO_3H_2$, —$OPO_3H_2$, or the salt thereof; and $R_1$ represents an organic residue which may have a substituent, provided that $R_1$ does not have the partial structure of ϕ, or a compound represented by formula (II-2);

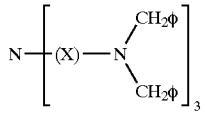

(II-2)

wherein X represents an alkylene linkage group having from 3 to 10 carbon atoms or a cycloalkylene linkage group having from 3 to 10 carbon atoms, each group may be substituted and ϕ represents —$PO_3H_2$, —$OPO_3H_2$, or the salt thereof.

DETAILED DESCRIPTION OF THE INVENTION

Then, the present invention will be described in detail.

In formulae (I) and (II), $R_1$ represents a hydrogen atom, or an alkenyl, cycloalkyl, alkenyl, or aralkyl group having from 1 to 18, and preferably at least 2 carbon atoms, each group may be substituted and as the substituent, there are an alkoxy group, a sulfide group, an amino group, a halogen atom, a cyano group, a nitro group, a hydroxy group, a carboxy group, a phosphonic acid group, a phosphoric acid group, a sulfonic acid group (including the salts of these acid groups), an amido group, a sulfonamido group, an ester group, a urea group, a urethane group.

In formula (III), X represents an alkylene linkage group preferably having from 3 to 10 carbon atoms, which may be substituted, (e.g., methylene, ethylene, propylene, butylene, 1-methylethylene, 1-methylpropylene, 2-methlbutylene, hexylene, 1-hydroxybutylene, 2-hydroxybutylene, 2-hydroxypropylene, 1-carboxybutylene, and 2-carboxybutylene) or a cycloalkylene linkage group which may be substituted (e.g., 1,4-cyclohexylene, 1,3-cyclobutylene, cyclopropylene, 1,3-cyclopentanylene, 1,2-cyclohexylene, 1,3-bis(methylene)cyclohexane, 1,4-bis (methylene)cyclohexane, 1,3-bis(methylene)cyclopentane, and 1,2-cyclohexylene).

In formulae (I) and (II), $R_1$ preferably represents a hydrogen atom, an alkyl group having from 1 to 14 carbon atoms, which may be substituted, (e.g., methyl, ethyl, propyl, isopropyl, butyl, isobutyl, heptyl, hexyl, octyl, decyl, dodecyl, hexadecyl, octadecyl, 2-hydroxyethyl, 2-hydroxypropyl, 3-hydroxypropyl, 4-hydroxybutyl, 2-hydroxy-butyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinomethyl, pyrrolidinoethyl, 2-chloroethyl, 2-chlorobutyl, 2-bromoethyl, 2-cyanoethyl, 4-cyanobutyl, 2-carboxyethyl, carboxymethyl, 3-carboxypropyl, 3-morpholinopropyl, 2-morpholinoethyl, 2-sulfoethyl, 2-piperidinoethyl, amidomethyl, thioethyl, imidazolididoethyl, sulfonamidoethyl, phosphonopropyl, and phosphonomethyl-amino-ethyl), an alkenyl group which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, vinyl, 2-propenyl, and 3-butenyl), an aralkyl group which may be substituted (e.g., benzyl, phenetyl, 3-phenyl-propyl naphthylmethyl, 2-naphthylethyl, chlorobenzyl, bromobenzyl, methylbenzyl, ethylbenzyl, methoxybenzyl, di-methylbenzyl, dimethoxybenzyl, cyanobenzyl, nitrobenzyl, hydroxybenzyl, carboxybenzyl, dimethylaminobenzyl, naphthyl, adamantyl, amidobenzyl, and sulfonamidobenzyl), or a cyclo-alkyl group which may be substituted (e.g., cyclopropyl, cyclobutyl, cyclopentyl, cyclohexyl, cycloheptyl, 4-methyl-cyclohexyl, 4-chlorocyclohexyl, 4-methoxycyclohexyl, 4-cyanocyclohexyl, and isophorone).

In formula (IV), Y preferably represents a hydrogen atom, an alkyl group having from 1 to 6 carbon atoms, which may be substituted, (e.g., methyl, ethyl, n-propyl, i-propyl, n-butyl, i-butyl, t-butyl, n-pentyl, i-pentyl, n-hexyl, neopentyl, chloromethyl, carboxymethyl, carboxyethyl, hydroxyethyl, and dimethylaminoethyl), an alkoxy group which may be substituted (e.g., methoxy, ethoxy, propoxy, and butoxy), a halogen atom (e.g., fluorine, chlorine, bromine, and iodine), an amino group, a nitro group, a cyano group, a carboxy group, or a hydroxy group.

Further, in the compounds used in the treatment liquid of the present invention, those having an even number of a phosphonic acid group or a phosphate group provide superiority in scumming at the 10,000th printed matter from the initiation of printing over those having an uneven number of a phosphonic acid group or a phosphate group.

Then, specific examples of the compounds shown by formulae (I) to (IV) described-above being used in this invention are illustrated below but the compounds in this invention are not limited by these compounds.

Also, in the specific examples illustrated below, 2EH represents

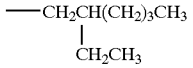

(2-ethylhexyl group)

and n-Oct represents n-$C_8H_{18}$ (n-octyl group).

1.

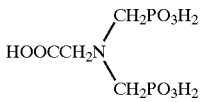

2.

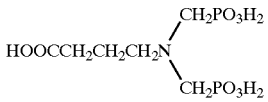

3.

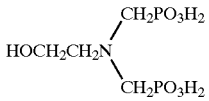

4.

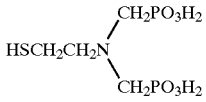

5.

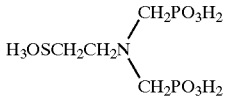

6.

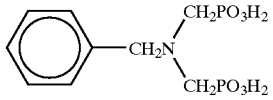

7.

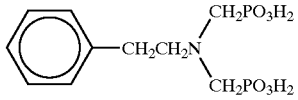

8.

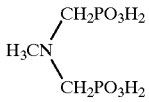

9.

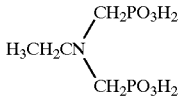

10.

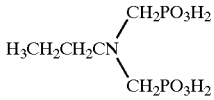

-continued
11.
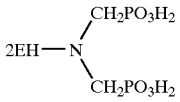
12.
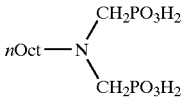
13.
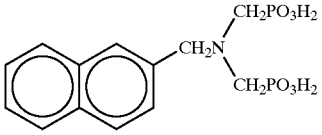
14.
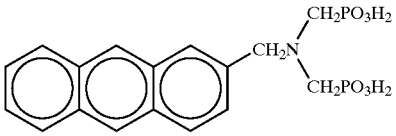
15.
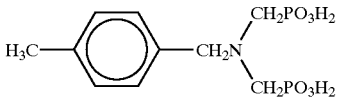
16.
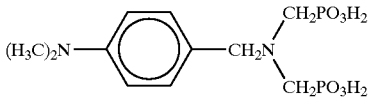
17.
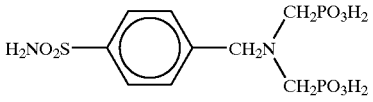
18.
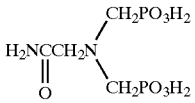
19.
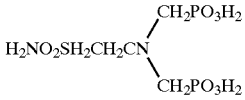
20.
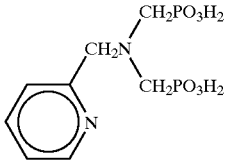
21.
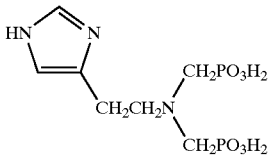
22.
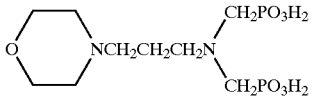
-continued
23.
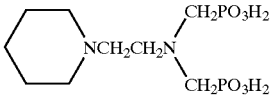
24.
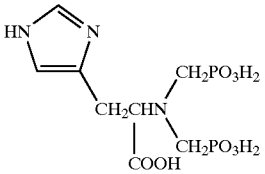
25.
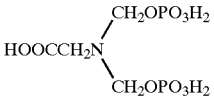
26.
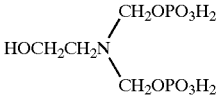
27.
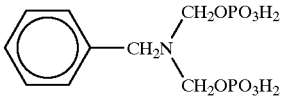
28.
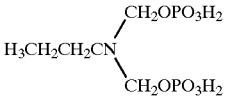
29.
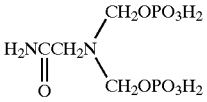
30.
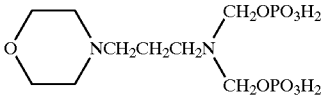
31.
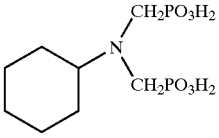
32.
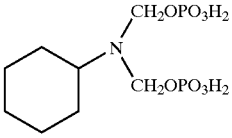
33.
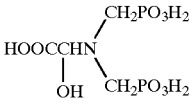
34.
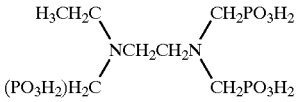
35.
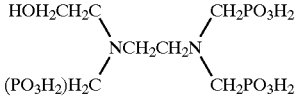

-continued
36.
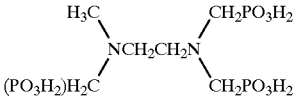
37.
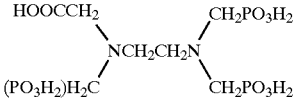
38.
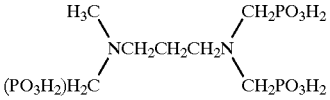
39.
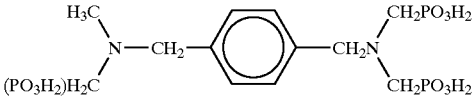
40.
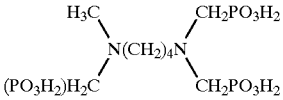
41.
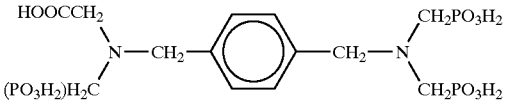
42.
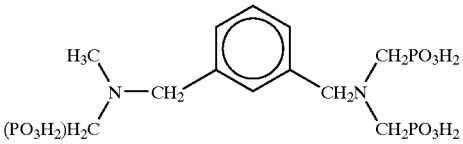
43.
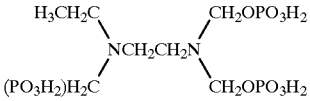
44.
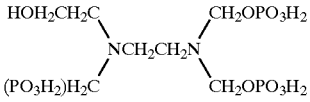
45.
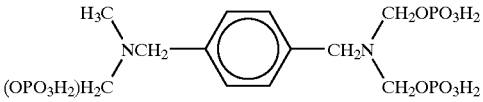
46.
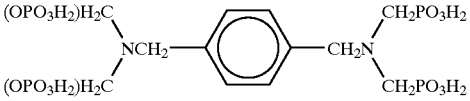
47.
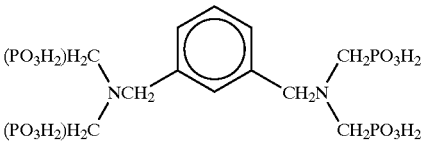
48.
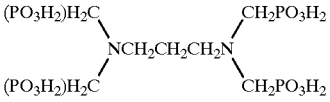
-continued
49.
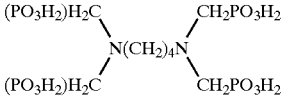
50.
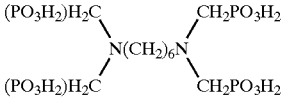
51.
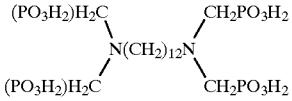
52.
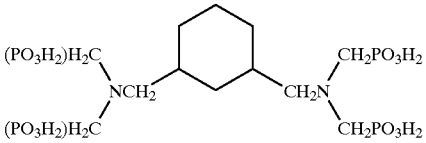
53.
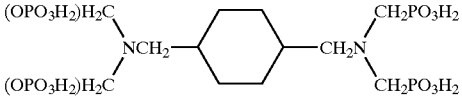
54.
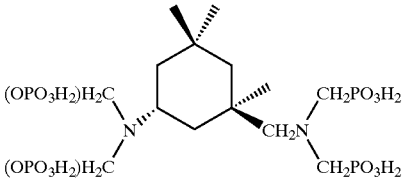
55.
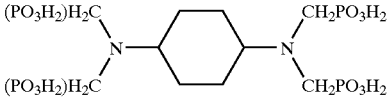
56.
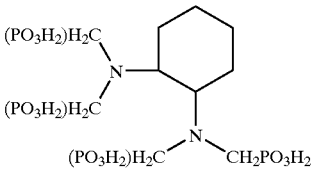
57.
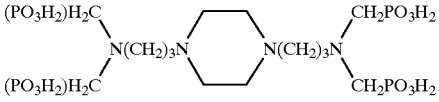
58.
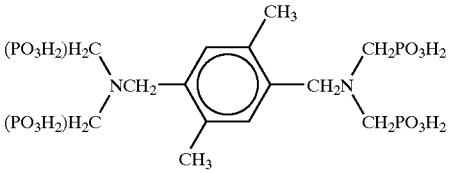
59.
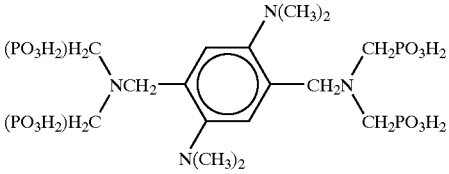

-continued
60.
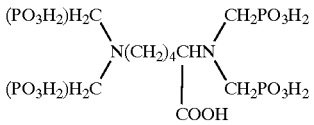
61.
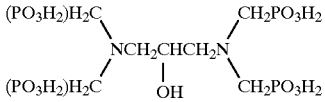
62.
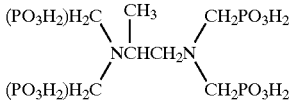
63.
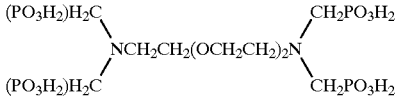
64.
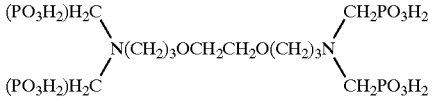
65.
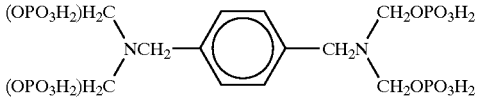
66.
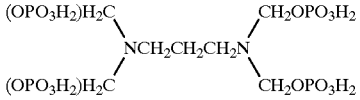
67.
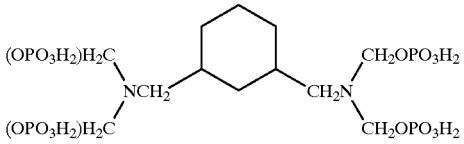
68.
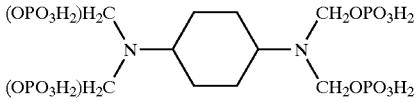
69.
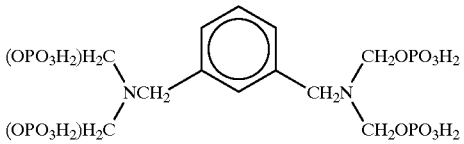
70.
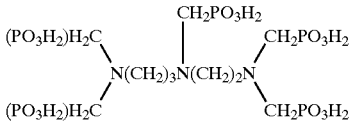
71.
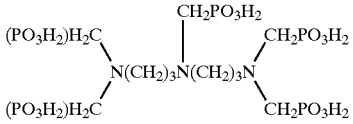
-continued
72.
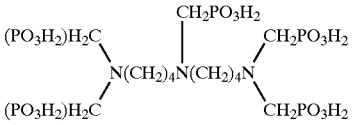
73.
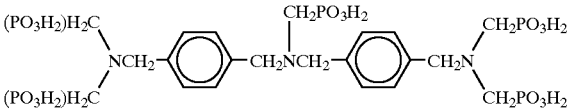
74.
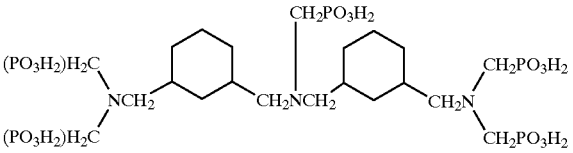
75.
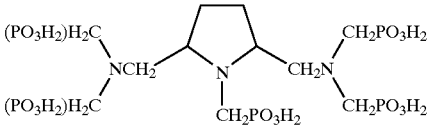
76.
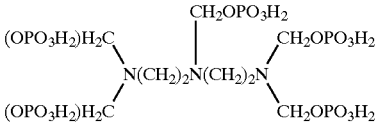
77.
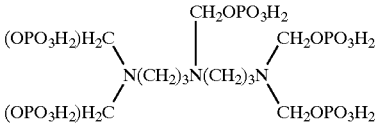
78.
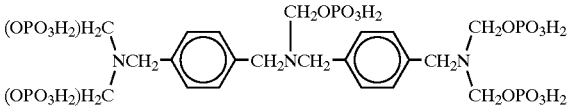
79.
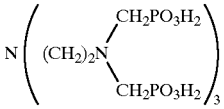
80.
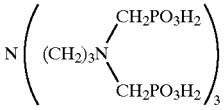
81.
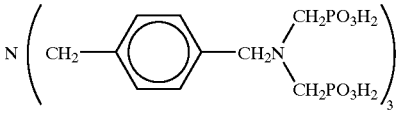
82.
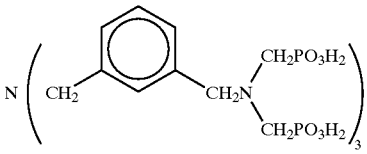

-continued

83.

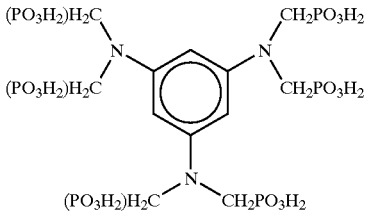

84.

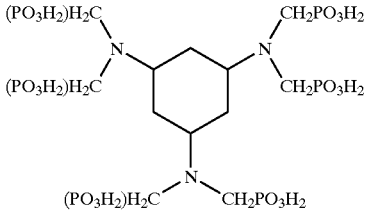

85.

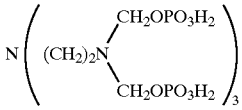

86.

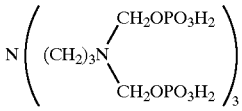

87.

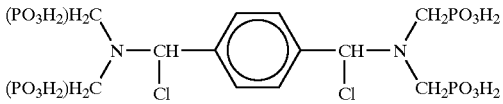

88.

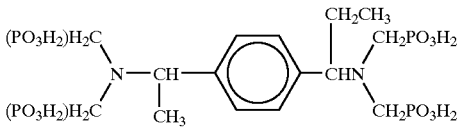

89.

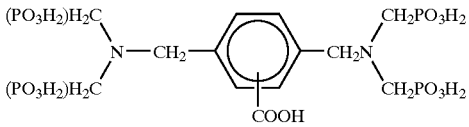

90.

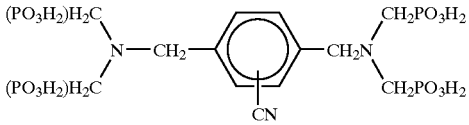

91.

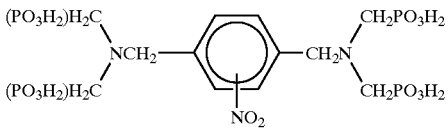

92.

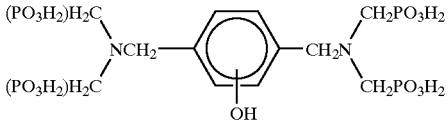

-continued

93.

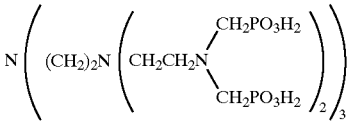

94.

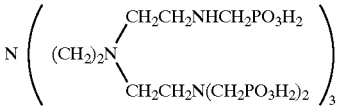

The compounds shown by formulae (I) to (IV) being used in the present invention can be synthesized by the addition reaction of the Schiff base and phosphonic acid, the dehydration condensation reaction of an alcohol and orthophosphoric acid, the condensation reaction of an alcohol and phosphorus oxychloride, etc., described in *Synthesis*, 81 to 96 (1979) and *Jikken Kagaku Koza* (*Experimental Chemistry Course*) 19, published by Maruzen K. K., 1957.

As the using amount of the material constituting the treatment liquid of this invention, the amount of the compound in this invention having a chelate-forming faculty with a zinc ion is from 10 to 300 parts by weight, and preferably from 30 to 100 parts by weight per 1,000 parts by weight of the treatment agent of the present invention.

Also, the compounds shown by formulae (I) to (IV) described above may be used singly or as a mixture of two or more kinds thereof.

The compound(s) being used in this invention are dissolved in ion-exchanged water or tap water to provide the desensitizing treatment liquid of this invention. The treatment liquid of this invention may further contain an organic acid, an inorganic acid, or a basic hydroxide such as potassium hydroxide, sodium hydroxide, etc., as a pH controlling agent; ethylene glycol, sorbitol, glycerol, gum arabic, dipropylene glycol, dimethylacetamide, hexylene glycol butanediol, butyl cellosolve, a surface active agent, etc., as a wetting agent; salicylic acid, phenol butyl para-benzoate, sodium dehydroacetate, 4-isothiazolin-3-one, 2-bromo-2-nitro-1,3-propanediol, chloroacetamide, etc., as an antiseptic; and EDTA, pyrophosphoric acid, metaphosphoric acid, hexametaphosphoric acid, 2-mercaptobenzimidazole, etc., as a rust preventive agent at proper amounts in addition to the foregoing component.

Also, at the practicing the desensitizing treatment liquid of this invention, it is preferred that the pH value of the treatment liquid is in the range of from 3 to 6. Also, the treatment liquid can be used as a fountain solution by diluting with water.

Since in the foregoing compounds being used in this invention, the chelating reactivity and the precipitate-forming speed are greatly improved owing to the feature of the chemical structure thereof as compared with conventionally known compounds having a chelating faculty, such as phytic acid, phytates, etc., the hydrophilic treatment speed is improved and the treatment time is shortened, whereby it is presumed that the time of existing the printing plates in the treatment liquid is short even in the case of the same running number of the plates, intermixing of the $Zn^{2+}$ ion, etc., causes precipitations in the treatment liquid can be restrained, the treatment liquid shows, as a matter of course, a high desensitizing power, the stability of the treatment liquid with the passage of the time and the running property thereof are improved.

As described above, the desensitizing treatment liquid of this invention is an excellent cyan-free treatment liquid which does not contain a ferrocyan compound or a ferricyan compound causing the problem of environmental pollution and being deteriorated by light or heat, is stable when stored for a long period of time without causing discoloring and precipitations, is not influenced by the printing environment as compared with conventional cyan-free treatment liquids, greatly improves the film-forming speed, and can obtain offset printing master plates which do not cause scumming and plugging of halftone dot even in a high speed etching treatment.

The following examples serve to illustrate the present invention without limiting, however, the scope of this invention.

EXAMPLE 1

A system (desensitizing treatment liquid) composed of the following components;

| | |
|---|---|
| Water | 1,000 parts by weight |
| Xylylenediamine tetrakis-(methylenephosphonic acid) | 80 parts by weight |

EXAMPLE 2

A system as in Example 1, wherein propylenediamine tetrakis(methylenephosphonic acid) is used in place of the compound used in Example 1.

EXAMPLE 3

A system as in Example 1, wherein N-ethylethylenediamine tris(methylenephosphonic acid) is used in place of the compound used in Example 1.

EXAMPLE 4

A system as in Example 1, wherein ethylamine di(methylenephosphonic acid) is used in place of the compound used in Example 1.

COMPARATIVE EXAMPLE A

A system as in Example 1, therein phytic acid is used in place of the compound used in Example 1.

COMPARATIVE EXAMPLE B

A system as in Example 1, therein EDTA is used in place of the compound used in Example 1.

COMPARATIVE EXAMPLE C

A system as in Example 1, therein phosphonomethylimidinoacetic acid is used in place of the compound used in Example 1.

COMPARATIVE EXAMPLE D

A system as in Example 1, therein ethylenediamine tetrakis(methylenesulfonic acid) is used in place of the compound used in Example 1.

After sufficiently dissolving each of the foregoing compounds in the treatment liquids in water, pH of the solution was adjusted to 4.3 by the addition of KOH.

The practical skill evaluation results using these treatment liquids obtained are shown in Table 1 below.

TABLE 1 (1)

| Evaluation Terms | Scumming Property *1 | | Ink-Attaching Property *2 | |
|---|---|---|---|---|
| Environmental Condition | I 25° C./80% RH | II 35° C./80% RH | I | II |
| Example 1 | A | A | A | A |
| Example 2 | A | A | A | A |
| Example 3 | A | B | A | A |
| Example 4 | A | B | A | A |
| Comparative Example A | B | C | B | A |
| Comparative Example B | D | D | A | A |
| Comparative Example C | C | C | C | B |
| Comparative Example D | D | D | A | A |

*1) Scumming:
After allowing to stand a light-sensitive material, ELP-$I_x$ (electrophotographic lithographic plate, manufactured by Fuji Photo Film Co., Ltd.) and a fully automatic plate-making machine, ELP404V (trade name, manufactured by Fuji Photo Film Co., Ltd.) a whole day and night at normal temperature and normal humidity (20° C., 65% RH), a lithographic printing plate was prepared, reproduced images are formed and the reproduced master plate thus obtained was passed once through an etching machine containing each of the treated liquids prepared in Examples 1 to 4 and Comparative Examples A to D, respectively.
Then, each of the master plates was subjected to printing using a printing machine, Hamada Type 611XLA-II (manufactured by Hamada K.K.) and using the treatment liquids in Example 1 diluted 5 times with distilled water as a fountain solution under the environmental conditions shown in Table 1 (1) and the presence and absence of scumming of the 100th printed matter from the initiation of printing were visually evaluated.
*2) Ink-attaching property:
By the same manner as the case of the background stain (scumming) evaluation described above, reproduced master plates were prepared and each of the reproduced master plates obtained was passed once through an etching machine containing each of the treatment liquids prepared in Examples 1 to 4 and Comparative Examples A to D. Then, each of the reproduced master plates was subjected to printing as in the case of scumming evaluation and the ink-attaching state at the screen tint area of the 10th printed matter from the initiation of printing was visually evaluated.

TABLE 1 (2)

| Evaluation Terms | Running Property *3) | | Stability With Passage of Time *4) | |
|---|---|---|---|---|
| Example 1 | A | good | A | good |
| Example 2 | A | good | A | good |
| Example 3 | A | good | A | good |
| Example 4 | B | scumming formed a little | A | good |
| Comparative Example A | C | precipitate formed | C | scumming formed and deteriorated |
| Comparative Example B | D | scumming formed | — | no change |
| Comparative Example C | C | precipitate formed | D | scumming formed and deteriorated |
| Comparative Example D | D | scumming formed | — | no change |

*3) Running Property:
By the same manner as the case of scumming evaluation, reproduced maser plates were prepared and each of 2,000 reproduced maser plates obtained was passed once through the etching machine containing each of the treatment liquids prepared in Examples 1 to 4 and Comparative Examples A to D.
Thereafter, about the 2,000th master plate since then, printing and the evaluations of scumming and the evaluation of the formation of precipitates and the state of the treatment liquids were carried out as in the case of the evaluation of scumming.
*4) Stability With the Passage of Time:

TABLE 1 (2)-continued

| Evaluation Terms | Running Property *3) | Stability With Passage of Time *4) |
|---|---|---|

Each of the desensitizing treatment liquids prepared in Examples 1 to 4 and Comparative Examples A to D was placed under a thermal condition (50° C., 80% RH) for 2 weeks. Thereafter, each reproduced master plate was prepared as in the case of the scumming evaluation and the master plate was passed once through the etching machine containing each of the foregoing desensitizing treatment liquids. Then, printing and the evaluation of scumming were carried out as the case of the evaluation of scumming described above.

As is clear from the results shown above, the desensitizing treatment liquids in Examples 1 to 4 are good in scumming and the ink-attaching property and clearly have the ability of high level as compared with the treatment liquids in Comparative Examples A to D.

About the running property, in the treatment liquids of Comparative Examples A and C, precipitates form in the treatment liquids to lower the ability but the treatment liquids of this invention do not form precipitations, etc., and have almost the same ability even after running 2,000 printing plates. Furthermore, the treatment liquids of this invention in Examples 1 to 4 also have the good stability with the passage of time as compared with the treatment liquids in Comparative Examples A to D and have the ability of sufficiently enduring the storage of a long period of time.

As described above, the desensitizing treatment liquids which can endure the environmental conditions, the continuous use, and the storage of a long period of time, and do not form scumming were only the treatment liquids of this invention.

In addition, phosphonomethylimidinoacetic acid used in the treatment liquid of Comparative Example C seems to resemble the compound of this invention in the structure and is disclosed in JP-A-61-163897 as a chelating agent which can be used as a pH controlling agent, a precipitation preventing agent, etc. However, the structure thereof forms a chelate with free $Zn^{2+}$ at the two acetic acid groups (carboxylic acid groups) bonded to the nitrogen atom. In this case, the chelate compound shows a water-soluble property and phosphonomethylimidinoacetic acid used in Comparative Example C can be said that the effect for a desensitizing treatment liquid is less.

Also, ethylenediamine tetrakis(methylenesulfonic acid) used in Comparative Example D is the compound formed by changing propylene of propylenediamine tetrakis (methylenephosphonic acid) used in Example 2 to ethylene, that is changing the alkylene having three carbon atoms to the alkylene having two carbon atoms. However, it could be seen that the compound having the alkylene having three carbon atoms used in Example 2 greatly differs from the compound having the alkylene having two carbon atoms in scumming and the running property.

EXAMPLES 5 TO 22

By changing the compound used in Example 1 to each of the compounds in this invention shown in Table 2 below and also changing the addition amount of each compound as shown in Table 2, the evaluation terms as in Example 1 were investigated.

TABLE 2

| Ex. No. | Compound of Invention* | Amount (w.p.) | Ex. No. | Compound of Invention* | Amount (w.p.) |
|---|---|---|---|---|---|
| 5 | 46 | 40 | 14 | 79 | 80 |
| 6 | 46 | 60 | 15 | 94 | 80 |
| 7 | 46 | 100 | 16 | 2 | 80 |
| 8 | 48 | 40 | 17 | 10 | 80 |
| 9 | 48 | 60 | 18 | 22 | 80 |
| 10 | 48 | 100 | 19 | 29 | 80 |
| 11 | 53 | 80 | 20 | 35 | 80 |
| 12 | 57 | 80 | 21 | 39 | 80 |
| 13 | 71 | 80 | 22 | 66 | 80 |

In the above table:
Ex. No.: Example Number
*(Compound number illustrated in the specification)
(w.p.): (part by weight)

The desensitizing treatment liquids of Examples 5 to 22 were good in scumming, the ink-attaching property, the endurance to environmental changes, the running property, and the stability with the passage of time as the case of the treatment liquid of Example 1.

EXAMPLES 23 TO 28

By combining several kinds of the compounds of this invention were combined as shown in Table 3 and fixing the addition amount of the combined compounds to 80 parts by weight, desensitizing treatment liquids were prepared and the occurrence of scumming, the ink-attaching property, the running property, and the stability with the passage of time were evaluated as in Example 1.

TABLE 3

| Ex. No. | Combined Compounds (*) [wt. %] | Ex. No. | Combined Compounds (*) [wt. %] |
|---|---|---|---|
| 23 | (46)/(48) = 50/50 | 31 | (4)/(6)/(79) = 25/25/50 |
| 24 | (46)/(48) = 25/75 | 32 | (60)/(67)/(71) = 25/25/50 |
| 25 | (46)/(48) = 75/25 | 33 | (62)/(67)/(22) = 25/25/50 |
| 26 | (46)/(52) = 50/50 | 34 | (52)/(34)/(22) = 25/25/50 |
| 27 | (48)/(79) = 50/50 | 35 | (33)/(34)/(46)/(48) = 25/25/25/25 |
| 28 | (48)/(71) = 50/50 | 36 | (2)/(6)/(46)/(48) = 25/25/25/25 |
| 29 | (46)/(48)/(79) = 25/25/50 | 37 | (5)/(10)/(48)/(79) = 25/25/25/25 |
| 30 | (4)/(6)/(57) = 25/25/50 | 38 | (7)/(20)/(46)/(52) = 25/25/25/25 |

In the above table;
Ex. No.: Example Number
(*): Numbers of the compounds illustrated in the specification.

The desensitizing treatment liquids in Examples 23 to 28 were good in the occurrence of scumming, the ink-attaching property, the endurance to environmental changes, the running property, and the stability with the passage of time as in Example 1, which shows several kinds of the compounds of this invention being used without causing problems.

EXAMPLES 39 TO 45

Desensitizing treatment liquids were prepared by adding various kinds of the wetting agents, the antiseptics, and the rust preventing agents shown in Table 4 below to the desensitizing treatment liquid having the same composition as in Example 1 and the several properties were evaluated as in Example 1.

TABLE 4

| Ex. No. | Wetting Agent | Antiseptic | Rust Preventing Agent |
|---|---|---|---|
| 39 | Ethylene Glycol | Salicylic Acid | EDTA |
| 40 | " | " | Metaphosphoric Acid |
| 41 | " | " | 2-Mercapto-benzimidazole |
| 42 | " | Sodium Dehydro-acetate | EDTA |
| 43 | Gum Arabic | Salicylic Acid | " |
| 44 | Dimethyl-acetamide | " | " |
| 45 | Butyl Cellosolve | " | " |

In the above table;
Ex. No.: Example Number

The desensitizing treatment liquids of Examples 39 to 45 were good in the occurrence of scumming, the ink-attaching property, the endurance to environmental changes, the running property and the stability with the passage of time, which show that the addition of foregoing various additives to the desensitizing treatment liquids of this invention does not give any influences on the abilities of the treatment liquids.

EXAMPLE 46

By using the treatment liquid containing the compound of this invention diluted with water as a fountain solution, a test for press life was carried out. In this case, as the desensitizing treatment liquid for master plates, the treatment liquid in Example 1 was used.

In the example, the treatment liquid of Example 1 diluted 5 times with distilled water was used as the fountain solution.

COMPARATIVE EXAMPLE E

The treatment liquid of Comparative Example A diluted 5 times with distilled water was used as the fountain solution.

COMPARATIVE EXAMPLE F

The treatment liquid of Comparative Example C diluted 5 times with distilled water was used as the fountain solution.

The evaluation results of Example 46 and Comparative Examples E and F are shown in Table 5 below.

TABLE 5

| Evaluation Term | Example 46 | Comparative Example D | Comparative Example F |
|---|---|---|---|
| Scumming of printed matters | No scumming until 5,000 plates | scumming formed at 2,000 plates | scumming formed at 1,000 plates |

From the results shown above, it can be seen that in the case of using the desensitizing treatment liquid of the present invention as the fountain solution, the occurrence of scumming is less as compared with the case of using the treatment liquids of Comparative Examples D and E as the fountain solution and thus the desensitizing treatment liquid of this invention also has a high ability as a fountain solution.

EXAMPLE 47

A system (desensitizing treatment liquid) composed of the following components;

| | |
|---|---|
| Water | 1,000 parts by weight |
| Compound shown in Table 6 | 80 parts by weight |

was prepared in the same manner as in Example 1, and printing scumming was evaluated as follows.

Scumming:

After allowing to stand a light-sensitive material, ELP-$I_x$ (elecrtophotographic lithographic plate, manufactured by Fuji Photo Film Co., Ltd.) and a fully automatic plate-making machine, ELP404V (trade name, manufactured by Fuji Photo Film Co., Ltd.) a whole day and night at normal temperature and normal humidity (20° C., 65% RH), a lithographic printing plate was prepared, reproduced images are formed and the reproduced master plate thus obtained was passed once through an etching machine containing each of the treated liquids prepared in Example 47, respectively.

Then, each of the master plates was subjected to printing in an ordinary manner using a printing machine, Hamada Type 611XLA-II (manufactured by Hamada K.K.) and using the treatment liquids in Example 1 diluted 20 times with distilled water as a fountain solution, and the printed number at which scumming was observed was evaluated.

TABLE 6

| Compound used | Scumming properties |
|---|---|
| Ethylamine di(methylenephosphonic acid) | 5,000 |
| Aminotris (methylenephosphonic acid) | 200 |
| Xylylenediamine tetrakis (methylenephosphonic acid) | 10,000 or more |
| Diethylenetriamine penta (methylenephosphonic acid) | 500 |
| Tris (3-aminopropyl) aminehexa-(methylenephosphonic acid) | 10,000 or more |
| Tetraethyleneheptamine (methylenephosphonic acid) | 1,000 |

As is clear from Table 6, when printing was conducted by using the treating liquid containing the compound of the present invention, the compound having an even number of a phosphonic acid group provides superiority over the compound having an uneven number of a phosphonic acid group.

As described above, according to the present invention, a desensitizing treatment liquid for offset printing plates which gives no problems to environmental pollution, is stable to the long-period storage, the continuous use, and environmental changes, can shorten the etching treatment time, and is excellent in the desensitizing treatment ability can be provided. Also, by properly diluting the desensitizing treatment liquid of this invention with water, the diluted treatment liquid can be effectively used as a fountain solution for offset printing plates.

While the invention has been described in detail and with reference to specific embodiments thereof, it will be apparent to one skilled in the art that various changes and modifications can be made therein without departing from the spirit and scope thereof.

What is claimed is:

1. A desensitizing treatment liquid for lithographic printing, which contains at least one compound represented by formula (III):

(III)

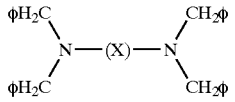

wherein X represents an alkylene linkage group having from 3 to 10 carbon atoms or a cycloalkylene linkage group having from 3 to 10 carbon atoms, each group may be substituted and ϕ represents —$OPO_3H_2$, or a salt thereof, said compound being capable of chelating with zinc ion or titanium ion which is generated from a zinc oxide or titanium oxide existing on the surface of a lithographic printing plate by etching treatment to form a sparingly water-soluble precipitation;

wherein the amount of the compound is 10 to 300 parts by weight per 1000 parts by weight of the desensitizing treatment liquid.

2. The desensitizing treatment liquid for lithographic printing of claim 1, wherein X of formula (III) is an alkylene linkage chain having 3 to 5 carbon atoms.

3. The desensitizing treatment liquid for lithographic printing of claim 1, wherein the amount of the compound is 30 to 100 parts by weight per 1000 parts by weight of the desensitizing treatment liquid.

4. The desensitizing treatment liquid for lithographic printing of claim 1, wherein the desensitizing treatment liquid has a pH from 3 to 6.

5. The desensitizing treatment liquid for lithographic printing of claim 1, wherein the desensitizing treatment liquid further comprises a pH controlling agent.

6. The desensitizing treatment liquid for lithographic printing of claim 1, wherein the desensitizing treatment liquid further comprises a pH controlling agent selected from the group consisting of an organic acid, an inorganic acid and a basic hydroxide.

7. The desensitizing treatment liquid for lithographic printing of claim 1, wherein the desensitizing treatment liquid further comprises a wetting agent.

8. The desensitizing treatment liquid for lithographic printing of claim 1, wherein the desensitizing treatment liquid further comprises an antiseptic.

9. The desensitizing treatment liquid for lithographic printing of claim 1, wherein the desensitizing treatment liquid further comprises a rust preventative.

10. The desensitizing treatment liquid for lithographic printing of claim 1, wherein the desensitizing treatment liquid is cyan-free.

11. A desensitizing treatment liquid for lithographic printing, which contains at least one compound represented by formula (IV):

(IV)

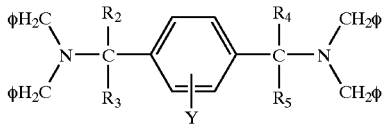

wherein $R_2$, $R_3$, $R_4$, and $R_5$ each represents a hydrogen atom, an alkyl group having from 1 to 3 carbon atoms, which may be substituted, or a halogen atom; Y represents an alkyl group having from 1 to 6 carbon atoms, which may be substituted, an alkoxy group which may be substituted, a halogen atom, an amino group, a nitro group, a cyano group, a carboxy group, or a hydroxy group; and ϕ represents —$PO_3H_2$, —$OPO_3H_2$, or a salt thereof, said compound being capable of chelating with zinc ion or titanium ion which is generated from a zinc oxide or titanium oxide existing on the surface of a lithographic printing plate by etching treatment to form a sparingly water-soluble precipitation.

12. The desensitizing treatment liquid for lithographic printing of claim 11, wherein the amount of the compound is 10 to 300 parts by weight per 1000 parts by weight of the desensitizing treatment liquid.

13. The desensitizing treatment liquid for lithographic printing of claim 6, wherein the amount of the compound is 30 to 100 parts by weight per 1000 parts by weight of the desensitizing treatment liquid.

14. The desensitizing treatment liquid for lithographic printing of claim 11, wherein the desensitizing treatment liquid has a pH from 3 to 6.

15. The desensitizing treatment liquid for lithographic printing of claim 11, wherein the desensitizing treatment liquid further comprises a pH controlling agent.

16. The desensitizing treatment liquid for lithographic printing of claim 11, wherein the desensitizing treatment liquid further comprises a pH controlling agent selected from the group consisting of an organic acid, an inorganic acid and a basic hydroxide.

17. The desensitizing treatment liquid for lithographic printing of claim 11, wherein the desensitizing treatment liquid further comprises a wetting agent.

18. The desensitizing treatment liquid for lithographic printing of claim 11, wherein the desensitizing treatment liquid further comprises an antiseptic.

19. The desensitizing treatment liquid for lithographic printing of claim 11, wherein the desensitizing treatment liquid further comprises a rust preventative.

20. The desensitizing treatment liquid for lithographic printing of claim 11, wherein the desensitizing treatment liquid is cyan-free.

* * * * *